US005409130A

United States Patent [19]

Saunders

[11] Patent Number: 5,409,130

[45] Date of Patent: Apr. 25, 1995

[54] ONE-PIECE DRAW-PROCESS CAN BODIES

[75] Inventor: William T. Saunders, Weirton, W. Va.

[73] Assignee: Weirton Steel Corporation, Weirton, W. Va.

[21] Appl. No.: 866,661

[22] Filed: Apr. 8, 1992

Related U.S. Application Data

[60] Division of Ser. No. 573,548, Aug. 27, 1990, Pat. No. 5,119,657, which is a continuation-in-part of Ser. No. 831,624, Feb. 21, 1986, Pat. No. 5,014,536, which is a continuation-in-part of Ser. No. 712,238, Mar. 1, 1985, abandoned.

[51] Int. Cl.[6] ..... B65D 81/34

[52] U.S. Cl. ..... 220/458

[58] Field of Search ..... 220/458, 457

[56] References Cited

U.S. PATENT DOCUMENTS

| | | | |
|---|---|---|---|
| 3,206,848 | 9/1965 | Reintmeester | 220/458 X |
| 3,219,729 | 11/1965 | Meyers et al. | 220/458 X |
| 3,360,157 | 12/1967 | Bolt et al. | 220/64 |
| 4,238,050 | 12/1980 | Le Grow | 220/458 |
| 4,734,303 | 3/1988 | Fujiwara et al. | 220/457 X |

*Primary Examiner*—Steven M. Pollard

*Attorney, Agent, or Firm*—Raymond N. Baker; Shanley and Baker

[57] ABSTRACT

Draw processing flat-rolled sheet metal substrate preselectively precoated on each surface with organic coating and draw lubricant into one-piece can bodies ready for assembly into sanitary packs free of any requirement for washing, organic coating or repair of organic coating after fabrication and before such direct usage. Selective organic precoating includes embodying a blooming compound which is made available as draw lubricant responsive to heat and/or pressure of draw forming; also, surface application of a draw lubricant after curing of the organic coating. Combined lubricant on each surface is verified before start of fabricating. Draw-forming of tensile strength sheet metal is controlled over side wall height by clamping solely between planar clamping surfaces and by interruption of draw to establish a flange at the open end of cup-shaped work product. Surface area of the cavity entrance zone for each die is preselected along with curved surface transition zone on draw punch in relation to sheet metal substrate starting gage. Nesting of curvilinear clamping surfaces of the prior art is eliminated during redraw of work product. The curved transition zone of cup-shaped work product is reshaped prior to redraw.

5 Claims, 7 Drawing Sheets

FIG. 16
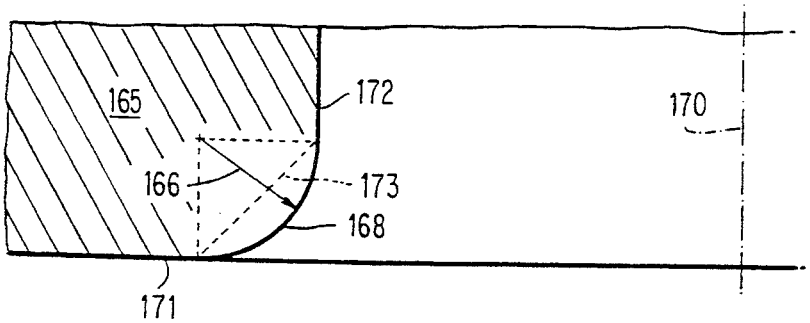
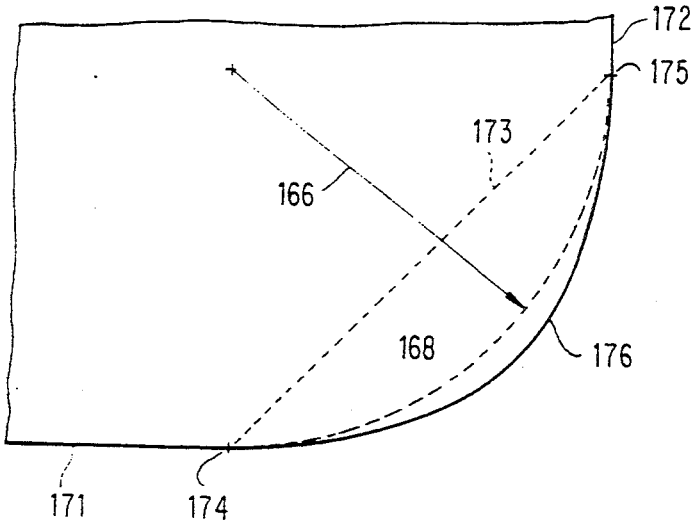
FIG. 17
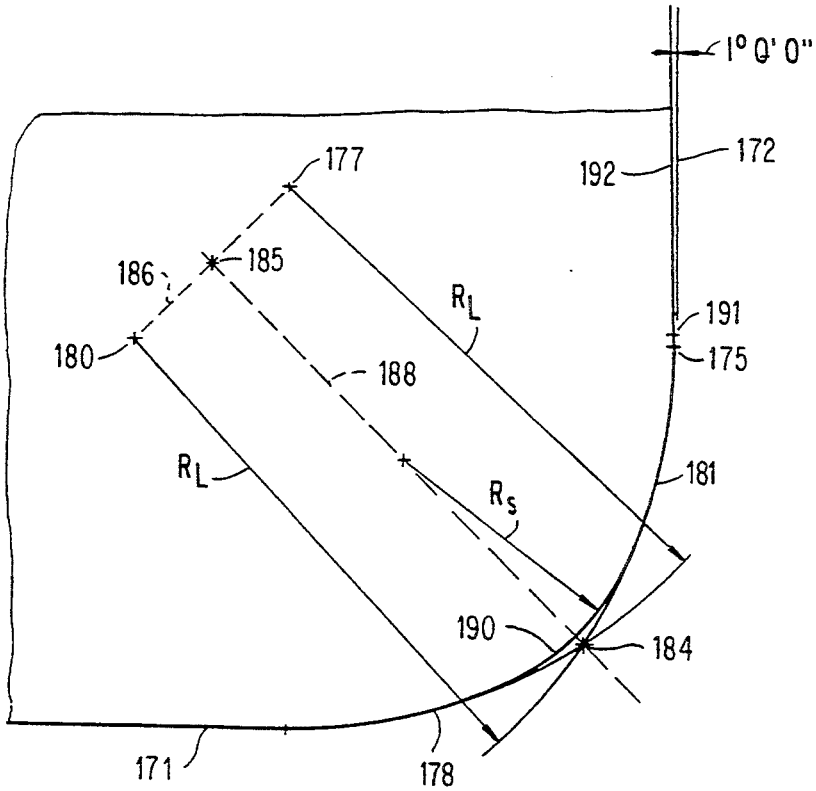
FIG. 18

ONE-PIECE DRAW-PROCESS CAN BODIES

This application is a division of application Ser. No. 07/573,548 filed Aug. 27, 1990, the entire disclosure of which is incorporated herein by reference (now U.S. Pat. No. 5,119,657 dated Jun. 9, 1992), which was a continuation-in-part of application Ser. No. 831,624 "DRAWN CAN BODY METHODS, APPARATUS AND PRODUCTS," filed Feb. 21, 1986 (now U.S. Pat. No. 5,014,536 dated May 14, 1991) which was a continuation-in-part of U.S. application Ser. No. 712,238 entitled "DRAWN CAN BODY METHODS, APPARATUS AND PRODUCTS" filed Mar. 1, 1985 (now abandoned).

This application is a continuation in part of application Ser. No. 831,624, "Drawn Can Body Methods, Apparatus and Products," filed Feb. 21, 1986, which was a continuation in part of U.S. application Ser. No. 712,238, "Drawn Can Body Methods, Apparatus and Products," filed Mar. 1, 1985 (now abandoned).

This invention relates to new fabricating processes, apparatus and sheet metal can body products. More particularly, this invention is concerned with draw processing flat-rolled sheet metal precoated with an organic coating and draw lubricant into one-piece can bodies for use in the manufacture of two-piece containers. In one of its more specific aspects, the invention is concerned with a system for draw processing such precoated flat-rolled sheet metal into can bodies as required for direct use in sanitary can packing of comestibles.

For various reasons demands to eliminate the side seam on cans and to develop a one-piece can body with a closed bottom wall and a unitary side wall have been increasing for more than a decade. The need is greatest for can bodies of the longitudinal height typically used for packing fruits, vegetables, soups, and the like. However, three-piece cans have continued to dominate such food can market largely because of the economy of three-piece cans; but, also, at least in part, because of problems associated with prior one-piece can body fabricating methods and the added costs of carrying out such prior methods.

For example, during prior art draw operations, the sheet metal thickened along the side wall height increasing as much as 30% in approaching the open end of the can body where two or more sequential draw steps were required to produce a can body in which side wall exceeded cross-sectional diameter.

Also, prior art approaches involving "ironing" (cold forging) to decrease the thickness of such side wall metal by forcing a mandrel-mounted drawn cup through a restricted opening die (see e.g. U.S. Pat. No. 4,485,663) introduced other washing, coating, coating repair and/or handling obstacles to achieving economic production of one-piece can bodies.

Such wall thickening and/or such "cold forging" aspects also make it difficult to achieve the integrity demanded in commercial foodstuff packaging for any organic coating applied prior to such one-piece can body fabrication.

The present invention provides new systems for fabricating one-piece can body product free of added lubrication requirement during fabrication and free of any post-fabrication can body washing, organic coating or repair requirements. New methods, tooling configurations and relationships are provided which enable direct production of one-piece can bodies from flat-rolled steel precoated with organic coating (of a type suitable for the comestible) and a draw lubricant (of a type approved by regulatory agencies such as the U.S. Food and Drug Administration).

The above and other advantages and contributions of the invention are considered in more detail in describing embodiments of the invention as shown in the accompanying drawings. In these drawings.

Figure 7:
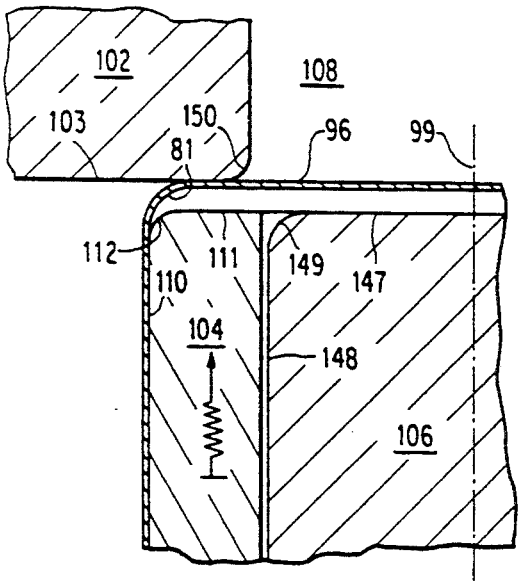
FIG. 7 is a schematic cross-sectional partial view of tooling in accordance with the present invention as arranged before start of redraw of a new cup cross section of increased side wall height from such work product of FIG. 6.
Figure 13:
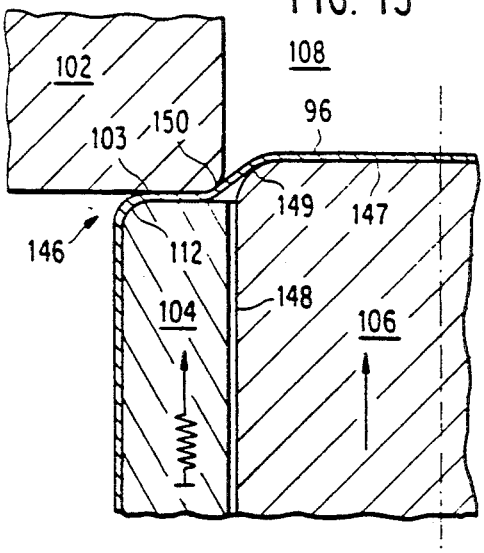
Figure 12:
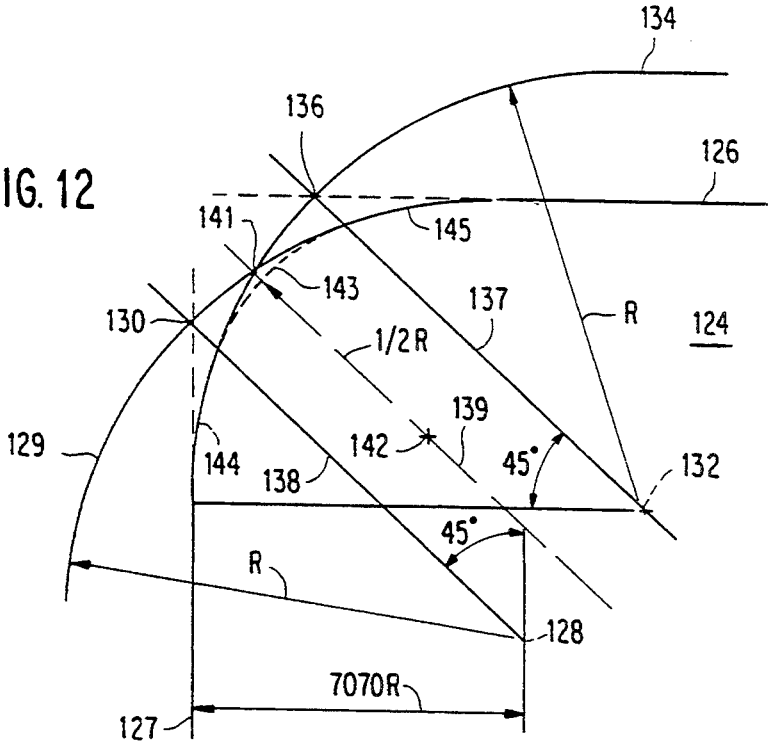
Figure 14:
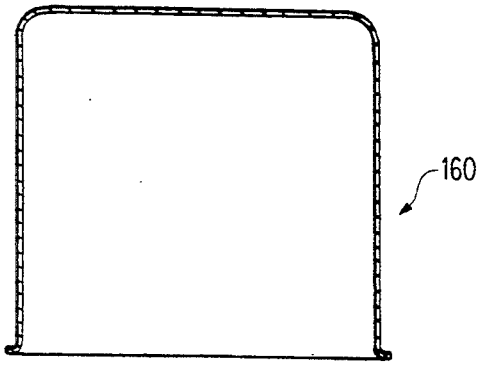
Figure 15:
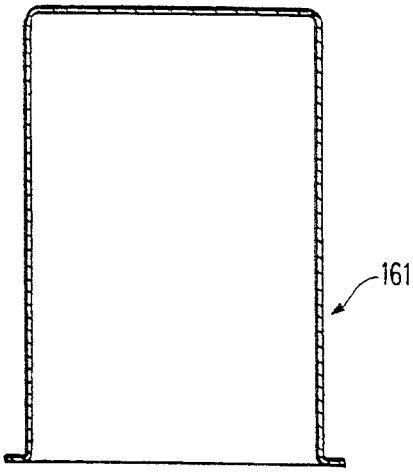
Figure 19:
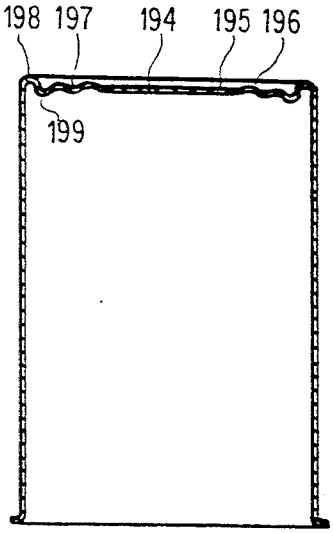
Figure 20:
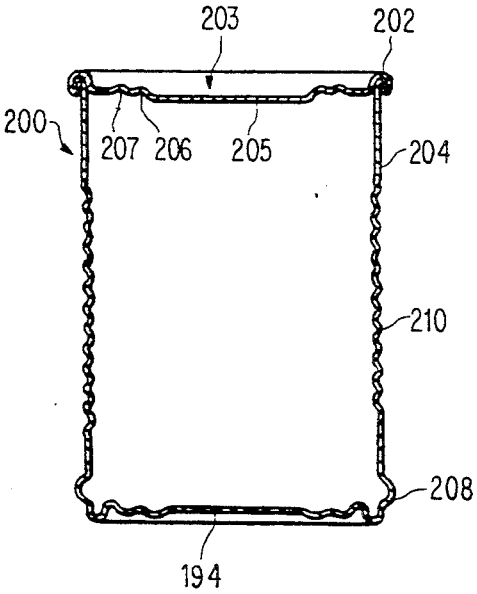

FIGS. 8, 9, 10, and 11 are schematic cross-sectional partial views of tooling and work product illustrating the sequential steps in accordance with the invention for reshaping the curved surface juncture, between the endwall and side wall of a drawn cup, in preparation for redrawing a new cup-shaped article of increased side wall height;

FIG. 12 is a cross-sectional illustration for describing manufacture of a curved surface about multi-pleradii of curvature for the transition zone between the endwall and external side wall of a clamping tool of the invention;

FIG. 13 is a schematic cross-sectional partial view of the apparatus of FIG. 7 at the start of decreasing the bottom wall area of a cup-shaped work product to be added to side wall height;

FIG. 14 is a cross-sectional view of a redrawn cup-shaped article in accordance with the present invention;

FIG. 15 is a cross-sectional view of an additional redrawn cup-shaped article in accordance with the present invention;

FIGS. 16, 17 and 18 are vertical cross-sectional views of portions of a draw die for describing configurational aspects of a cavity entrance zone and cavity side wall, and manufacture thereof, in accordance with the invention;

FIG. 19 is a cross-sectional view of a final redraw can body showing bottom wall profiling in accordance with the present invention;

FIG. 20 is a cross-sectional view of a two-piece can showing a can body of the invention with bottom wall and side wall profiling, along an end closure assembled using can body flange to form a chime seam; and FIGS. 21, 22, 23 and 24 are schematic cross-sectional partial views of apparatus illustrating final redraw clamping, release and bottom wall profiling of a sheet metal work product in accordance with the invention.

Figure 1:
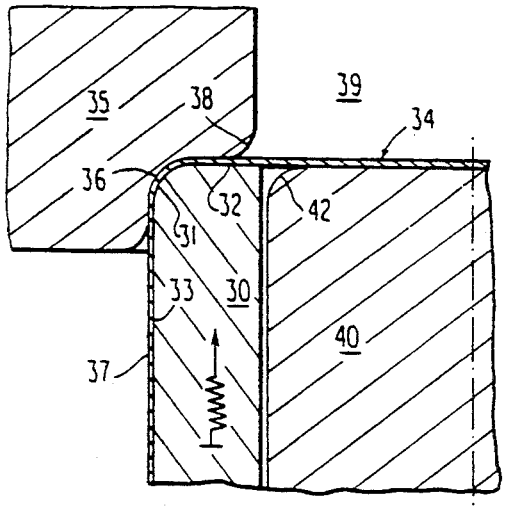
FIG. 1 PRIOR ART
FIG. 1 is a schematic cross-sectional partial view of prior art tooling with sheet metal clamped between compound curvature surfaces immediately prior to start of redraw of a new diameter.
Figure 2:
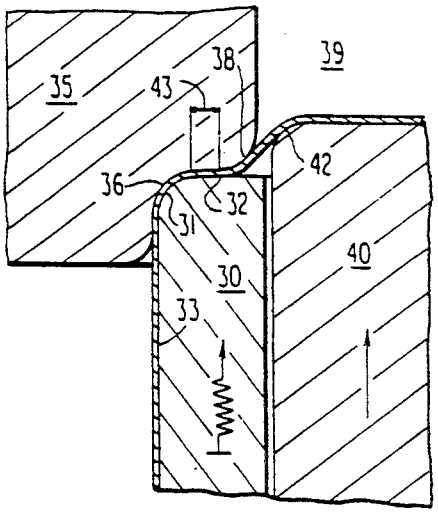
FIG. 2 PRIOR ART
FIG. 2 is a schematic cross-sectional partial view of the prior art tooling of FIG. 1 as the new diameter is being formed.

Prior art redraw technology for can body manufacture relied on nesting of curved surfaces (as shown in cross section in FIGS. 1 and 2). Part of such nesting arrangement was to have curved clamping surfaces (as seen in a vertically oriented plane which includes the central longitudinal axis of the cup) match the curved surface juncture (as seen in such plane) between the endwall and side wall of a cup-shaped work product during redraw to a smaller transverse cross sectional area and increased side wall height. When working with cylindrical or elliptical can bodies, or at the curved corner portions of rectangular or oblong can bodies, such "nesting" required matching of compound curvature surfaces; that is, surfaces which are curvilinear as viewed in cross section in both a plane which includes the central longitudinal axis and in a plane which is perpendicularly transverse to such central longitudinal axis.

Redraw clamping ring 30 of the prior art had a curved surface at its transition zone 31 between endwall 32 and side wall 33 which was designed to match as closely as possible the dimensional and configurational characteristics of the curved internal surface at the juncture of the endwall and side wall of cup 37.

And, draw die 35 had a curved clamping surface 36 which attempted to clamp over the entire outer curved surface area of the juncture for sheet metal cup 37.

As part of the present invention it was concluded that the random and sometimes excessive increase in thickness gage of the side wall sheet metal experienced with prior art draw-processing added to other difficulties in attempting to match such curved surface.

Another tenet of prior draw redraw practice was to make the radius of curvature for curved surface 38, at the entrance of die cavity 39, as large as possible while avoiding wrinkling of the sheet metal during relative movement of male punch 40 into such cavity (FIG. 2). Also, the radius of curvature for the curved surface 42 (referred to as the "nose portion") between the side wall and endwall of male punch 40, was preselected to be as small as possible without causing "punch out" of the metal. Typically, prior art radius of curvature dimensions for such tooling during the first redraw operation in forming a 211×400 can (2 11/16" diameter by 4" height) were as follows:

| | |
|---|---|
| clamping ring surface "31" - .125" | cavity entrance surface "38" - .070" |
| draw die surface "36"- .135" | punch nose radius "42" - .125" |

With present teachings, sheet metal side wall substrate thickening is eliminated or controllably localized and minimized so as not to significantly affect organic coating adhesion. Thickening of side wall sheet metal substrate, if any, is localized toward the distal end of the side wall open end or of the flange metal which is provided by the invention. As a result, flat-rolled sheet metal precoated with organic coating and draw lubricant can be processed into can bodies ready for direct packing, as fabricated, without can body washing, can body coating or repair steps of any nature, or flange metal orientation steps.

Figure 3:
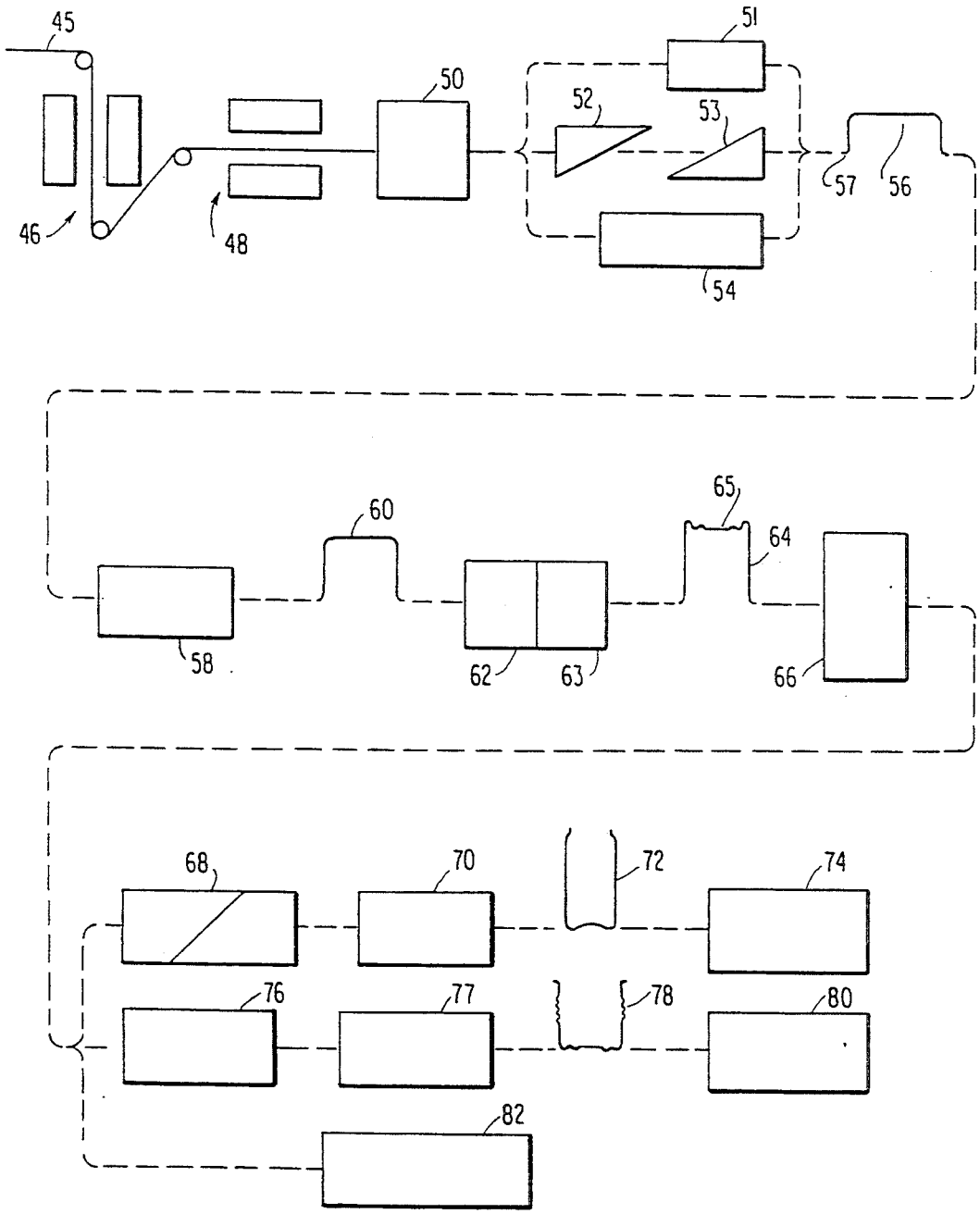
FIG. 3 is a diagrammatic general-arrangement presentation for describing the overall system and method of the invention for preparing one-piece can bodies from can stock comprising flat-rolled sheet metal precoated with organic coating and draw lubricant.

Referring to the general arrangement schematic of FIG. 3, flat-rolled sheet metal 45 of predetermined gage is selectively precoated on each surface with organic coating and draw lubricant. As part of the improved production-line teachings of the invention, a draw lubricant in the form of a "blooming" compound is embodied in the organic coating; for example, as part of the "solids" content in the solvent or carrier for the organic coating; or, as part of a solid film organic coating application. Such blooming compounds function as draw lubricants responsive to the heat and/or pressure of forming operations so as to be made available during reshaping of the can stock. The organic coating and draw lubricant are preselected for each surface based on forming or other requirements. Also, surface coating of draw lubricant (petrolatum) is carried out upon completion of application and curing of the organic coating; and, the combined lubricant on each surface, blooming compound and surface application, is quantitatively determined before fabricating.

Precoating of organic coating and draw lubricant is preferably carried out selectively as to each surface dependent on product protection or forming requirements for each such surface. Enabling such separate surface coating capability is shown diagrammatically in FIG. 3. Flat-rolled sheet metal 45 is prepared and selectively coated on each surface with a film or solvent or carrier based organic coating and blooming compound at station 46 which carries out curing and/or removal of solvent or carrier. After such curing of the organic coating, a surface lubricant coating is selectively applied to each surface at station 48 as required to provide a desired combined lubricant coating weight. As taught herein for present substrate surface preparation practice and available organic coatings, such combined lubricant coating weight is selected in the range of about 15 to about 20 mg/sq. ft. per surface. The type of organic coating and the type of blooming compound embodied with it, as taught herein, are preselected for each can stock surface in relation to which surface will be on the "product" side of a can and which will be on the "public" side of a can. Quantitative testing of total lubrication on each surface can be carried out at the completion of station 48 processing or subsequently before start of fabrication.

The draw processing taught herein can place greater requirements for protection against galling on the external surface (public side) of the cup-shaped work product requiring a blooming compound with the organic coating on such surface. Such blooming compound and surface lubrication amounts are preselected and carried out with the capability of being verified before fabrication, so as to make the can body fabricating system free of any subsequent requirement, or interruption, for lubrication during movement of can stock into or through the can body fabrication line. This enables more efficient coordination of can body fabrication to processing requirements of foods for packing. For example, can bodies can be produced on demand for direct packing as needed by the food processing line without concern for coordinating any step(s) for surface lubrication of can stock or work product with can body fabricating line operations.

Thus, the invention provides for carrying out precoating of organic coating and draw lubricant independently of fabricating line movement; and, for verification of each precoated surface before start of fabrication. Interruptions in fabricating line movement (for example, due to food processing line and/or packing contingencies) are thus isolated from such can stock surface preparation steps. Providing for selection of type of organic coating and type of blooming compound, if any, for each surface along with surface-applied lubricant as part of such coating practice for each surface thus enables dedication of a can body fabricating line to the needs of a food processing line. This enables the can body fabricating line to be turned "on" and "off" in response to requirements of a particular food processing line. A one-piece can body fabricating line, capable of being controlled directly in response to packing demand without wastage of can stock or processed food, has not been disclosed previously in the one-piece can body art.

Referred to in FIG. 3, the draw lubricant coating on each surface can be verified as precoated can stock is accumulated at station 50. Precoated can stock can be accumulated as cut blanks, sheet stacks, or as a continuous-strip coil; or, through use of other strip accumulator means which in a preferred embodiment isolate fabricating ling demand from surface preparation.

Embodying a blooming compound with the organic coating, and selective surface lubrication as taught, eliminate any need for intermediate lubrication of can stock or work product in the can body fabricating line; and, help provide the advantage that the formed can body is ready for direct use as fabricated; there are no forming lubricants to be washed off as in draw and iron practice for example.

In a first can stock feed alternative of FIG. 3, cut blanks are fed into cupper 51. In a second alternative, cut sheets or continuous strip can be fed into blanking apparatus 52 from which cut blanks are directed into cupper 53; or, in a third alternative, cut sheets or continuous strip can stock can be fed into apparatus 54 for cutting a blank and forming a cup at the same station.

Precutting of the flat-rolled sheet metal precoated with organic coating and draw lubricant into sheets or into cut blanks (having cut-edge dimensional and configurational characteristics determined by final one-piece can body requirements) contributes another commercial advantage. Enabling a line to be fed with precoated cut blanks enables a transportable fabricating line for one-piece can bodies to be located and supplied when and where needed for processing particular foodstuffs; cut blanks or sheets for the cut blanks can be flat-packed, shipped and handled in bundle sizes not requiring the special heavy-duty equipment needed for coil handling. Further, use of cut blanks eliminates concern with return of scrap.

Referring to FIG. 3, a shallow-depth, large cross section cup 56 is formed with flange 57 about the open end of its side wall. Such flange provides a surface for conveying the can body in the production line. Also, the disposition of such flange maintains the desired open end configuration to receive matching tool configurations for the next forming operation and helps coordination of the fabricating system taught. Such flange presentation is provided throughout draw-processing taught herein enabling tension control throughout side wall height. Providing the flange interrupts side wall elongation and the flange is properly oriented for forming a chime seam, with an end closure structure, to complete assembly of a two-piece container.

Thus, cup-shaped work product is formed, and is fed "open-end-down" on flange 57 onto what is termed the "pass line" in the system taught. This system enables the cup-shaped work product to travel from a forming station along a path in position for direct feeding into a subsequent press; and, each press discharges its work product for travel in such "pass line." The system taught herein avoids driving work product through tooling which would require accumulation off-line (which has been a requirement of prior one-piece can body lines). Also, travel in the pass line need not await withdrawal of a work product from female or male tooling; that is, preferably, as taught herein, the work product as drawn is in position for discharge on its flange onto the pass line. Suitable presses for such an integrated system for one-piece can body fabrication of the invention have been made available through Standun Conforming Systems (Division of Sequa Corporation), 2943 East Las Hermanas Street, Rancho Dominguez, Calif. 90221 so as to enable accomplishing such teachings of the invention.

Delivery "open-end-down" in the pass line is preferred throughout the can body forming process; in other words, the cup-shaped work product travels in line (on its flange) from one station to the next properly oriented for each operation; the "open-end-down" orientation throughout draw processing facilitates internal cleanliness for the can bodies.

A redraw operation involves decreasing the bottom wall surface area by adding bottom wall can stock to side wall height. Cross sectional area for a can body is measured in a transverse plane which is perpendicular to the central longitudinal axis of symmetry of the can body while the side wall height is measured in a "vertical" plane which includes such central longitudinal axis. In a cylindrical configuration can body the single cross sectional dimension of interest is the diameter; other configurations are generally considered as having two cross-sectional dimensions.

Each draw operation of the invention provides a flange, at the open end defined by the side wall, oriented in a plane substantially perpendicularly transverse to the central longitudinal axis of the can body. Also, in each such draw operation of the invention the side wall is increased in height while such side wall metal is under controlled tension by clamping throughout side wall height.

Referring to FIG. 3, a first redraw of cup 56 is carried out at redraw station 58; the resulting redrawn work product 60 is delivered in the pass line for subsequent redraw(s). In a final redraw, cup-shaped work product (such as 60) is delivered into a final redraw station 62. In a preferred embodiment, bottom wall profiling means 63 forms part of the final redraw station 62. Can body 64 is then delivered with preselected profile endwall 65.

"Bottom profiling" refers to forming a bottom wall contouring which provides desired bottom wall strength; bottom profiling may be carried out for additional purposes such as the interfitting of cans (bottom into top) during stacking.

The type of flange trimming carried out at station 66 is dependent on intended can body usage. If the open end of a cylindrical-configuration can body is to be "necked-in" significantly (in relation to the main side wall cross section), for example, for certain types of carbonated beverage cans, the transversely oriented flange metal is first removed entirely. Such removal of the flange (at station 66) is generally carried out by cutting in a circumscribing path perpendicularly transverse to the central longitudinal axis of the can body. The open end is necked-in and then re-flanging is carried out; this is schematically indicated by the pressure-pack finishing operation alternative of FIG. 3 in which a flange-free can body is both necked-in and a new flange formed at station 68. Inspection and finishing are carried out at station 70; then, pressure pack can body 72 is delivered for filling and closure at station 74.

The flange formed during draw processing of the present invention is used directly in certain types of can packs. Such flange is properly oriented at the completion of the final redraw and the trimming at station 66 is carried out to the required size for a chime seam operation of the type used in sanitary can packs. Such trimming is carried out in a direction parallel to the central longitudinal axis of the can body by "flying shear" apparatus as described in U. S. Pat. No. 4,404,836.

For other than pressure-pack can bodies, profiling of the side wall is carried out at station 76; then inspection is carried out at station 77. The purpose is delivery of can body 78 ready for packing at station 80.

Present teachings facilitate side wall profiling. That is, drawing the side wall to prevent thickening of side wall metal provides an advantage for side wall profiling purposes by eliminating the ironing which has been used to thin side wall metal which had been thickened by conventional draw redraw practice; such ironing can result in significant side wall problems following side wall profiling carried out by currently available equipment. Indications are that such intermediate side wall ironing can lead to significant leakage areas as a result of the side wall profiling process. Such difficulties are not experienced with the side wall draw processing of the present invention.

Another discharge alternative for fabricated can bodies of the system shown in FIG. 3 is palletizing at station 82 for future can packing needs; palletizing can be carried out with or without wrapping for shipment.

A distinct advantage is that the can body as fabricated in-line from precoated can stock in accordance with the invention is ready for direct use by filling and completing chime seam attachment of an end closure. That is, the integrity of the preapplied organic coating is maintained, during the can body fabrication taught, during endwall profiling and during side wall profiling. Also, steps required of the prior art, that is, post-fabrication can body washing, coating or coating repair are not required. Such expensive post-forming steps are avoided by the present invention as is the damage which can result from attempting to carry out side wall profiling of a side wall which has been ironed.

Enabling one-piece can bodies to be deep drawn without damage to the metal or organic coating is related to (a) properly providing for guiding the can stock during draw redraw shaping, (b) providing solely for planar surface clamping which facilitates better control of side wall tensioning, (c) properly supporting the can stock during its multi-directional changes in shape (for example, during movement from a planar state into the configuration of a side wall), and (d) draw tensioning the side wall throughout its height. Also, sheet metal tensioning throughout side wall height avoids any increase in side wall metal gage throughout such height, facilitates organic coating adhesion and improves metal economics.

As taught herein, a relatively light gage, high tensile strength sheet metal which has been substantially work-hardened before start of the can body fabricating operation is a significant factor in obtaining certain desired results described above. Changes in metal characteristics during forming operations are avoided by using a work-hardened sheet metal. Work hardened steel, as taught herein, has the necessary longitudinal yield strength for drawing the side wall under tension. Such sheet metal is not subject to significant change in mechanical properties during draw operations as taught herein; and, therefore, provides for more uniform forming about the side wall and longitudinally. A specific embodiment is double cold-reduced flat-rolled steel having a longitudinal yield strength above seventy-five (75) to about eighty-five (85) ksi (kilopounds per square inch); such double cold-reduced steel is known as "double-reduced" in the steel industry (*Making, Shaping and Treating Steel*, 9th Ed., p. 971, ®1971, printed by Herbick & Held, Pittsburgh, Pa.) and has the temper designation of DR-8. A preferred example for specific embodiments described herein is 65 lb. per base box, double-reduced, tin free steel (TFS). A double cold- reduced product is cold-reduced about thirty to forty percent in place of temper milling so that the gage of the steel strip is reduced in two final cold mill reduction stages without an anneal. Tin free steel (TFS) refers to flat-rolled steel the surface of which has been passivated by a combined chrome-chrome oxide electrolytically applied coating. Other surface passivating treatments such as chrome oxide bath or cathodic dichromate electrolytic treatment also enhance adhesion for application of organic coating to steel substrate.

Can sizes and configurations are shown and/or described in the "Dewey and Almy Can Dimension Dictionary" published by the Dewey and Almy Chemical Division, W. R. Grace & Co., Cambridge, Mass. 02140. While metal economic objectives for can bodies could be met with the present invention across substantially the full spectrum of such standard can sizes, capital requirements for extended stroke (above e.g. about five and one-half inches) presses and market volume for such extended height cans are factors which have a bearing in commercial application. Considering these factors, data is provided within a preferred range for commercial application of the invention which covers standard can sizes with cross sectional linear dimension, for example, diameter for a cylindrical can being between about two inches to about four and one-quarter inches and, with side wall height above one inch to about five inches. Representative materials, tooling dimensions and relationships for can sizes in such preferred commercial range are set forth later herein.

The invention departs, initially, from prior draw tooling technology by changing size relationships of the tooling. In such prior art the die cavity entrance surface was formed about a radius of curvature selected to be as large as possible. In place of such prior teaching, cupping of a sheet metal blank is carried out using a die cavity having an entrance zone surface formed about a radius of curvature (as viewed in vertical cross section) which is selected to be as small as practicable; for example, about five times sheet metal starting thickness gage; and, having a maximum value of about 0.04" for the popular standard can sizes mentioned above. The objective is to draw the can stock into the die cavity putting the side wall under tension about a relatively sharply curved surface at the entrance zone to the cavity.

The invention further departs from prior draw redraw practice by teaching use of an enlarged curved surface at the peripheral working surface of the male punch; such curved surface is between the punch side wall and endwall; and, is often referred to as the "punch nose" because of its appearance as most often shown, i.e., in vertical cross section.

Prior draw practice taught forming the punch nose about as small a radius as possible seeking only to avoid "punch-out" of the metal. In the present invention reshaping is initiated about a much larger surface; the punch nose surface is formed about a significantly larger radius of curvature; that is, a radius of curvature which is about forty (40) times starting sheet metal thickness gage for the cup forming operation. Such radius of curvature dimension for forming the punch-nose surface can be partially dependent on the cup diameter being drawn. In the first (cupping) draw for fabricating a can body for a 211×400 soup can from precoated 65#/bb double-reduced, flat-rolled steel, the punch nose radius of curvature is selected at 0.275"; this cupping punch radius of curvature is practical for the preferred range of can size diameters set forth above.

Figure 4:
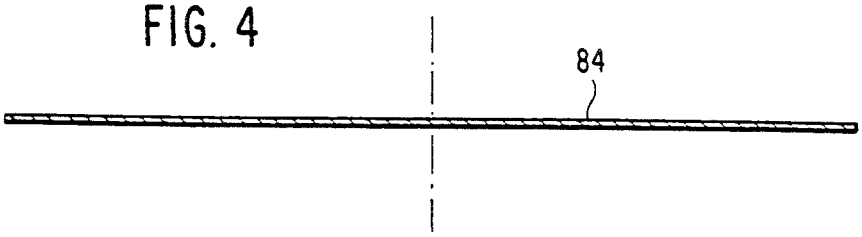
FIG. 4 is a cross-sectional view of a blank cut from such can stock.

FIG. 4 shows a can stock cut blank 84 of predetermined sheet metal thickness gage with cross-sectional dimensional values and configurational characteristics being selected for the desired size and configuration can body.

Figure 5:
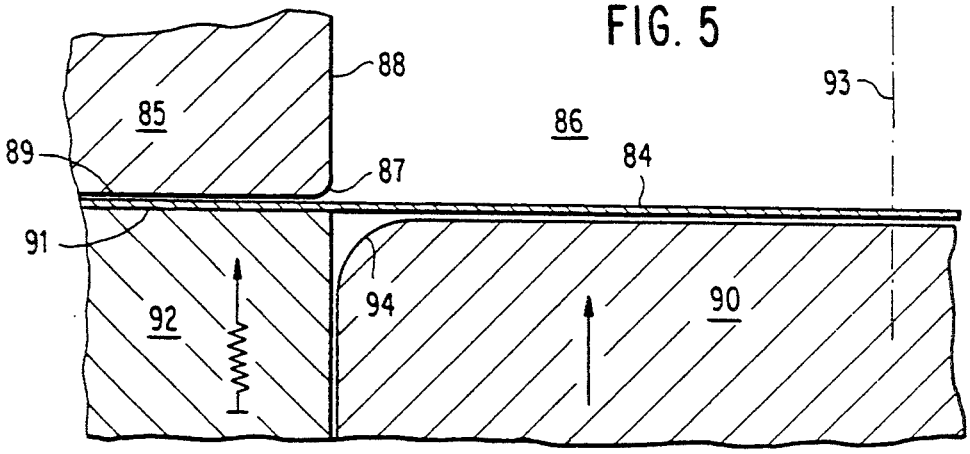
FIG. 5 is a schematic cross-sectional partial view of tooling for drawing a one-piece cup-shaped work product from a cut blank in accordance with the invention.

Cupping tooling is shown in the partial cross-sectional schematic view of FIG. 5. Draw die 85 defines die cavity 86 with entrance zone 87 between its internal side wall 88 and a planar clamping surface 89. Male punch 90 moves relative to die cavity 86, as indicated, as the blank 84 is clamped about peripherally external to male punch 90, between planar clamping surface 89 of draw die 85 and planar surface 91 of clamping sleeve 92. Such planar clamping surfaces are perpendicularly transverse to central longitudinal axis 93. The cavity entrance zone 87 as viewed in vertical cross section (that is, in a plane which includes the central longitudinal axis 93) has a curved surface formed about a 0.040", or smaller, radius dependent on sheet metal starting gage; or, can be formed about multiple radii of curvature as described later herein to provide a greater surface area without decreasing planar clamping surface.

Surface 94 at the nose portion of punch 90 presents a significantly larger surface area than used in prior practice and is formed about a radius of about forty times starting gage; 0.275" is a representative cupping operation for the punch nose radius of curvature for above-mentioned can body sizes using double reduced sixty-five pounds per base box TFS).

Drawn cup 96 (FIG. 6) includes endwall 97, side wall 98 which is symmetrical with relation to central longitudinal axis 99, flange metal 100 in a plane which is substantially perpendicularly transverse to axis 99, and juncture 101 between endwall 97 and side wall 98. Juncture 101 has a curved configuration in vertical cross section conforming to that of punch nose 94 of FIG. 5.

During cup forming, central longitudinal axis 99 for cup 96 is coincident with draw die central longitudinal axis 93; relative movement between tooling is carried out with such tool parts being oriented in symmetrical relationships to axis 93.

During redraw, the prior attempt to rely on curved clamping surfaces (FIGS. 1 and 2) is eliminated and solely planar clamping surfaces are relied on. Also, in the new technology, the cross-sectional curved-surface juncture, between the endwall and side wall of the drawn cup (96) to be redrawn, is first reshaped about a smaller curved surface. Such initial reshaping is carried out in a manner which creates a force on the work product bottom wall metal which is directed in a horizontal plane in a direction away from the central longitudinal axis (99). Such reshaping of the curved-surface cup juncture adds to the surface area of the can stock available for clamping between planar surfaces during redraw.

Figure 6:
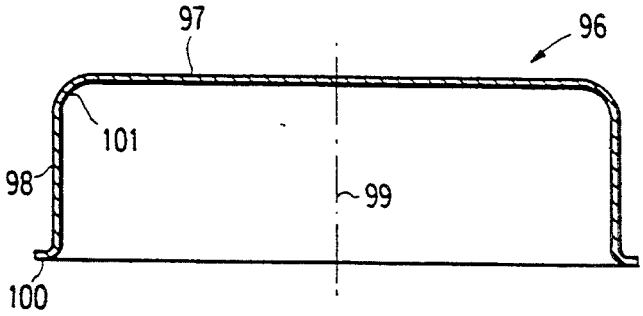
FIG. 6 is a cross-sectional view of such a cup-shaped work product with a closed bottom wall and a flange at its open end defined by its side wall.

FIG. 7 shows the juxtaposition of redraw tooling and drawn cup 96 in approaching cup juncture reshaping and redraw. Redraw die 102 can be considered as stationary for purposes of understanding reshaping of the juncture of a cup-shaped work product (it being understood that required relative movement between tool parts is carried out with various interrelated movements of individual upper or lower tooling with their centerline axes coincident). In practice, such relative movement between upper and lower tooling is preferably selected for purposes of discharging the work product onto the pass line without requirement for removal of the work product from tooling parts or accumulation of work product off line. In FIGS. 6, 7, and later apparatus figures, the open end of the cup is oriented downwardly during formation for discharge of the work product for travel, on the flange provided, in the pass line. The invention teaches use of a flat-face redraw die as shown in FIG. 7. That is, redraw die 102 presents solely planar clamping surface 103 and such planar clamping surface lies in a plane which is perpendicularly transverse to central longitudinal axis 99. Axially movable clamping tool 104 has a sleeve-like configuration and is disposed to circumscribe male punch 106. The male punch is adapted to move within cavity 108, defined by redraw die tool 102; with allowance being made for tooling and can stock (sheet metal and organic coating) clearance. Typical diametral clearances approach twenty-five thousandths inch 0.025") (about three times the thickness of the can stock) for organically coated 65#/bb double-reduced flat-rolled steel that is half that amount on each side of the punch as shown in cross section.

Clamping sleeve 104 includes external side wall 110, planar endwall 111 and curved-surface transition zone 112 therebetween. The outer dimension (peripheral side wall 110) of clamping sleeve 104 has an allowance for tool clearance of only about two and a half thousandths inch (0.0025") in relation to the internal side wall dimension of a work product cup such as 96; and, has a configuration in cross section conforming to the cross-sectional configuration of the can body.

In accordance with present teachings, the surface area of transition zone 112 of clamping sleeve 104 is significantly smaller about one fourth to about one-half the surface area of juncture 101 of cup 96; that is, in a specific embodiment, a projection of the transition zone 112 onto a clamping surface plane which is perpendicularly transverse to the central longitudinal axis occupies less than about 40% of the projection of cup juncture 101 on such plane (covered more specifically in relation to FIGS. 8 through 11).

The interrelationship of these curved surfaces is selected to provide a difference of at least 60% in their projections on the transverse clamping plane; this translates into a corresponding increase in planar clamping surface area when juncture 101 or cup 96 is reshaped about transition zone 112 (prior to otherwise starting metal movement into the die cavity by redraw forming). Such reshaping is shown and described in relation to FIGS. 8 through 11.

In a specific cylindrical-configuration side wall embodiment for sizes set forth above, the transition zone surface on the cupping punch uses a 0.275" radius of curvature to form cup juncture 101 so that the projection of such juncture on the transverse clamping plane is 0.275". The projection of transition zone 112 of the clamping sleeve curved surface transition zone (in accordance with later-described [FIGS. 8–12] multiple radius of curvature teachings of the invention) occupies 0071". This provides about a 75% difference; that is, a projection of the clamping ring transition zone (112) onto the transverse clamping plane presents a radial dimension which occupies about 25% of the projection of the 0.275" radius of curvature of juncture 101. Reshaping of the cup juncture as taught herein thus significantly increases the planar clamping surface area (in which the clamping sleeve surface coacts with the planar clamping surface 103 of die 102) over that which would be available in the prior art.

Figure 8:
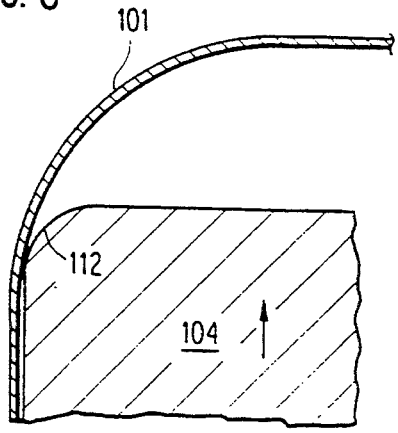
Figure 9:
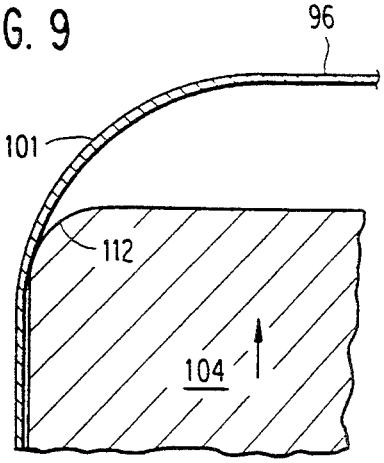
Figure 10:
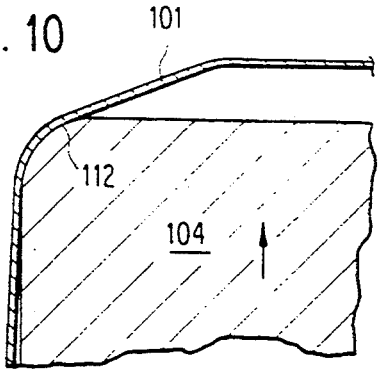
Figure 11:
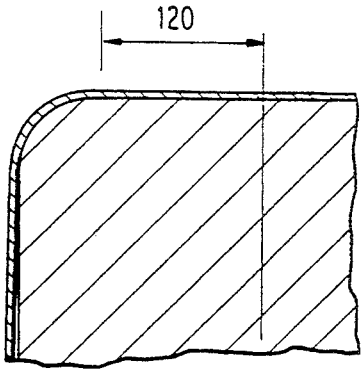

Referring to FIG. 8, as clamping sleeve 104 is moved against spring-loaded pressure its curved surface transition zone 112 comes into contact with the inner surface of juncture 101 of cup 96. With continued relative movement (FIG.9) an outwardly directed (away form the central longitudinal axis) force is exerted on the sheet metal of cup 96 as juncture 101 is reshaped (FIG. 10). Upon completion of such reshaping (FIG. 11), the can stock now available for clamping between planar clamping surfaces during redraw has been substantially increased; and, clamping takes place solely over such extended planar surface area between draw die planar clamping surface 103 (FIG. 7) and clamping ring planar surface 111. The planar clamping surface area increase over that previously available, due to such controlled reshaping of juncture 101 about clamping tool transition zone 112, is increased by an amount indicated at 120 in FIG. 11.

Such increased planar clamping surface is added to that made available by the feature of the invention which decreases the die cavity entrance zone surface; such smaller cavity entrance zone surface 112 increases the planar clamping surface area between the draw die and clamping tool.

As previously described, such die cavity entrance projection does not exceed 0.040", which is significantly less than taught by the prior art. Combining the effect of reshaping the cup juncture and use of a smaller cavity entrance zone projection increases the planar clamping surface available by a factor of at least two over that available with corresponding size in the prior art arrangement and practice.

An additional contribution of the invention involves manufacture of the clamping sleeve peripheral transition zone (as viewed in cross section) about multiple radii. Carrying out such multi-radii concept is described in relation to FIG. 12. A single radius of curvature for the clamping ring peripheral transition zone surface (as viewed in cross section) about a radius "R" would result in a projection on the transverse clamping plane of clamping endwall 102 dimensionally equal to "R." In place of such single radius, such curved surface is formed about multiple radii of curvature through selective usage of "large" and "small" radii of curvature in forming a curved surface transition zone for the clamping tool.

In FIG. 12, clamping sleeve 124 includes a planar endwall 126 (defining the transverse clamping plane perpendicular to the centerline axis of the cup); clamping sleeve 124 also includes a peripheral side wall 127. In preferred fabrication of the curved surface transition zone for the clamping tool, a "large" radius R is used about center 128 to establish circular arc 129 which is tangent to the planar endwall surface 126. Extending circular arc 129 through 45° intersects with the extended plane of peripheral side wall 127 at imaginary point 130.

Using the radius R about center 132 establishes circular arc 134 tangent to side wall 127; extending arc 134 through 45° intersects the transverse clamping plane of endwall 126 at imaginary point 136.

Straight line 137 is drawn between imaginary point 136 and center 132; straight line 138 is drawn between imaginary point 130 and center 128; interrupted line 139 is drawn so as to be equidistant between parallel lines 137, 138. Line 139 comprises the loci of points for the center of a "small" radius of curvature which will be tangent to both the circular arcs 129 and 134, so as to avoid an abrupt surface intersection at imaginary part 141. Using a radius of ½ R with its center 142 along line 139, circular arc 143 is drawn to complete a smooth, multi-radii curved surface for the transition zone of clamping ring 124.

As a result of the clamping sleeve design of FIG. 12, the projection of the multi-radii curved surface on the transverse clamping plane of endwall 102 is 0.0707 times R, resulting in further increase of almost 30% (29.3%) in the planar clamping surface over that available if a single radius R were used for the curved surface transition zone of clamping sleeve 124. Also, a more gradual curved entrance surface 144 into the transition zone is provided; and, a more gradual curved surface 145 into the transversely oriented clamping plane (from the transition zone) is provided. Curved surface 144 also provides for easier entrance of the clamping tool transition zone into contact with the internal surface of the curved juncture of the drawn cup for the reshaping step.

In a specific cylindrical-configuration embodiment for a multi-radii clamping ring transition zone tot reshaping a 0.275" radius of curvature puncture for work product cup 76, R is selected to be 0.100"; therefore, the projection of clamping sleeve multi-radii transition zone on the transverse clamping plane comprises 0.0707"; rounded off as 0.071". Other values for R can be selected; for example, a 1.25" radius of curvature for reshaping a cup juncture of substantially greater radius than 0.275"; or 0.9" for reshaping a smaller radius of curvature juncture; in general selecting R as 0.100" will provide desired results throughout the preferred commercial range of can sizes designated earlier.

As shown in cross section in FIG. 13, a funnel-shaped configuration 146 is established between planar surface 103 of draw die 102 and clamping sleeve transition zone 112 for movement of work product sheet material into the axially transverse clamping plane without damage to the coating as male punch 106 moves into cavity 108. A further relief can be provided by having surface 103 diverge away from the clamping plane at a location which is external (in a direction away from axis 99) of the planar clamping surface.

Male punch 106 includes endwall 147, peripheral side wall 148 and curved surface transition zone 149 between such endwall and side wall. In contrast to the small surface area of cavity entrance zone 150, a large surface area is provided at transition zone 149 (the punch nose). Overcoming the inertia in the material in order to start a side wall on a new diameter is facilitated by the large punch nose teaching. Coaction between such large surface area punch nose and a small radius of curvature cavity entrance zone surface, elimination of the prior art curved surface nesting arrangement, and increasing the planar clamping surface area during redraw combine to continue the control of side wall gage which was initiated during the cupping step. These measures also help to prevent surface damage ("galling") of organic coating surfaces.

Organic coating will withstand significant stretching without destroying its adhesion to a metal substrate which is also stretching correspondingly. But, when side wall metal increases significantly in thickness, surface area at such location is decreased significantly; and, surface adhesion of the organic coating is lost because of the decrease in surface area of the sheet metal to which the organic coating was applied. That is, the organic coating can stretch correspondingly with but cannot increase in thickness correspondingly with the sheet metal so that the excess organic coating separates from the sheet metal substrate which is represented by a crumbling or peeling action.

By utilizing side wall tension teachings of the present invention, with side wall draw extending over full side wall height and side wall draw being interrupted to provide a flange, side wall thickness gage is controllably decreased along substantially the full side wall height during each draw operation. Increase in substrate thickness, if any, is not significant for coating adhesion purposes and any such increase is limited to a minor side wall height portion contiguous to the open end of the side wall or at the distal end of the flange. That is, any side wall thickening is likely to be limited to a minor edge portion at the distal end of the clamped flange.

And, as shown by test data tabulated later herein, increase in thickness, if any, is extremely limited quantitatively in contrast to the prior art increases in side wall thickness of 12.5% to 25% and higher percentages experienced in approaching the open end. For example, in double-redraw practice in the above preferred range of can sizes, increase in side wall thickness is substantially eliminated throughout side wall height including portions contiguous to the open end; increase in a single test sample was less than 3% and limited to a location contiguous to flange metal.

The punch-nose radius for a first redraw, after the cupping operation, is selected to be about thirty times starting metal thickness gage; for example, in a specific embodiment for a 211×400 can, 65#/bb double reduced TFS, the first redraw punch-nose radius is two hundred and five thousandths of an inch (0.205).

The curved surface for the peripheral transition zone of the clamping tool uses the multiple radii of curvature teachings described earlier; for example, a surface which projects as 0.071" on the transverse clamping plane can be used during the second redraw in reshaping such first-redraw curved surface juncture of the work product (which has an internal surface radius of curvature of 0.205"); or, a new surface based on R=0.9" can be used in forming the multi-radii transition zone for the second redraw clamping tool as described above.

FIG. 13 shows the apparatus of FIG. 7 during formation of a new side wall cross section. Typical values for deep drawing a cylindrical-configuration one-piece can body for 211×400 size can from precoated 65#/bb flat-rolled double reduced TFS steel in accordance with the invention are as follows:

| Work Product | Diameter | Punch-Nose Radius | Cavity Entrance Radius | Projection of Clamp Tool Transition Zone |
|---|---|---|---|---|
| Circular blank | 6.7" | — | — | — |
| Shallow cup (first draw) | 4.4" | .275" | .028" | — |
| First-redraw cup | 3.2" | .205" | .028" | .071" |
| Second-redraw cup | 2.5" | .062" | .028" | .071" |

Typical sheet metal clearances in each draw are in the range of approximately one and one half to three (1.5 to 3) times can stock thickness, for example, above about 0.010" to about 0.025" per side (in cross section) for precoated 65#/bb flat-rolled steel.

In such a cylindrical can body embodiment of the invention, the diameter of a circular sheen metal blank is decreased about 25% to 40% during cupping; the work product cup diameter is decreased about 15% to 30% in a first redraw; and, the diameter of a first-redrawn cup is decreased about 15% to 30% when a second-redraw is utilized.

Typical diameters for other double-redraw cylindrical-configuration can body embodiments are:

| | Can Size 300 × 407 | Can Size 211 × 413 |
|---|---|---|
| circular cut edge | 7.6" | 7.2" |
| first draw | 5.2" | 4.4" |
| first redraw | 3.6" | 3.2" |
| second redraw | 3.0" | 2.7" |

Increasing the number of redraws with side wall tensioning as taught herein improves metal economics enabling a smaller cut blank to be used for the same size can body; for example, typical diameters for a triple-redraw configuration can body for the above 211×413 can size are:

| | |
|---|---|
| circular cut edge | 6.5" |
| first draw | 5.1" |
| first redraw | 3.9" |
| second redraw | 3.1" |
| third redraw | 2.7" |

Typical diameters for a single redraw cylindrical-configuration can body embodiment (can size 307×113) are:

| | |
|---|---|
| circular cut edge | 6.2" |
| first draw | 4.0" |
| redraw | 3.3" |

The punch-nose radius of curvature in a final redraw is selected based on requirements of final can body geometry; for such purposes and those of the invention, the desired radius of curvature at the closed end of the final redraw can body would, for example, be about ten times starting gage of the sheet material.

A first-redraw can body 160 is shown in FIG. 14 and a second-redraw can body 161 is shown in FIG. 15. In each instance, flange metal at the open end of the can is oriented transversely to its central longitudinal axis.

Using prior art draw redraw practices for a steel can body for a 211×400 can size, the increase about the circumference) in side wall sheet metal thickness approaching the open end of one double-redraw embodiment was about 17.5%. However, the average thickness, measured at about ¼" height increments over the entire side wall height resulted in an average side wall thickness about equal to gage (0.0075"); the latter is within The nominal gage range for 65#/bb flat-rolled steel can stock. With the present invention, average thickness along side wall height was 12.7% less than starting gage. Such data correspond to starting blank area requirements in practice of the present invention; the starting blank area is about 12% less with the present invention than the starting blank area requirement of the prior art. In a further specific embodiment of the invention for a can body for a 211×400 can size, the starting blank diameter is 6.718"; the starting blank diameter using prior art draw redraw practice is 7.267".

In specific embodiments of the invention, TFS substrate precoated with organic coating and draw lubricant was fabricated into can bodies as shown in a later final redraw can body embodiment (FIG. 19) for 211×400 cans utilizing a first and second redraw; side wall gage was then measured at about 0.2" increments (tabulated as "A" through "S") starting at the open end and proceeding longitudinally throughout the side wall height. The percentage change in side wall thickness (measured at four circumferential locations and averaged around the circumference) at each such incremental level is set forth in the Table below. In Example #1, side wall thickness increased only Slightly (less than 3%) solely at the first measurement location ("A") at the open end; decrease in thickness over side wall height averaged slightly less than 15%. In Example #2, side wall thickness decreased slightly at each incremental level; average decrease in thickness over the side wall height averaged slightly above 16%. Percentage changes in side wall thickness gage or nominal starting gage are shown:

TABLE

| Side Wall Measurement Locations Starting at 0.2" from Flange Metal of Figure 19 | Percentage Reduction Example #1 % | Example #2 % |
|---|---|---|
| A | (2.2)* | 2.0 |
| B | 4.8 | 8.7 |
| C | 9.7 | 11.2 |
| D | 14.7 | 17.0 |
| E | 17.9 | 18.6 |
| F | 18.9 | 19.2 |
| G | 20.4 | 21.2 |
| H | 21.5 | 22.1 |
| I | 21.2 | 23.1 |
| J | 22.1 | 23.8 |
| K | 22.8 | 24.1 |
| L | 22.5 | 23.8 |
| M | 14.1 | 23.2 |
| N | 10.6 | 11.2 |
| O | 11.8 | 13.1 |
| P | 13.1 | 13.8 |
| Q | 14.4 | 14.1 |
| R | 13.8 | 14.4 |
| S | 7.4 | 4.1 |

*(Increase)

Additional novel tooling configuration concepts for the draw die further facilitate simultaneous multi-directional movement of precoated flat-rolled sheet metal during draw (cupping and/or redraw) operations and help to prevent thickening of side wall metal while avoiding damage to either coating or sheet metal.

Difficulties in overcoming inertia in the material during initiation of such multi-directional shape changes can increase as can body production rate is increased. The relatively large surface area of the punch nose helps overcome such inertia; and, the relatively small surface area of the draw die cavity entrance Facilitates desired movement and tensioning of the sheet metal during draw operations. However, to held avoid surface damage during increased production rates, a new cavity entrances surface which does not sacrifice planar clamping surface area of the draw die, is provided while maintaining a desired surface area support for can stock moving into the die cavity as well as a sharper draw surface.

The die cavity entrance zone reshaping method taught by the present invention is combined with a change in die cavity configuration which helps eliminate adherence of can stock to the die. Notwithstanding tooling clearances from about one and one-half to three times coated can stock thickness the multi-directional movement required of the metal substrate in becoming a new cross sectional area can result in a type of metal "spring-back" action which can create a tendency for the can stock to adhere, in a manner which could be detrimental to surface coating, to the internal side wall surface of the draw die after leaving the cavity entrance zone as the draw punch moves within the draw cavity. A change in cavity entrance zone configuration along with a recessed taper for the internal side wall surface of the draw die minimizes or substantially eliminates the likelihood of such surface damage.

As part of such novel draw die configurational concepts, the cavity entrance zone is formed about multiple radii of curvature to increase its overall surface area (without increasing its projected area on a transverse clamping plane) while providing for a more gradual change in direction of movement of the coated sheet metal during draw operations; this is providing better support of such can stock during its movement in the early stages of movement into the cavity entrance zone and the later stages of movement of metal from such zone.

FIG. 16 is an enlarged vertical cross sectional view showing a cavity entrance zone for draw die 165 formed about a single radius of curvature 166 which has been dimensionally selected in accordance with earlier presented teachings (that is, about five (5) times sheet metal starting gage and no greater than about 0.040") Single-radius curved surface 168 for the entrance cavity is spaced from central longitudinal axis 170 shown and extends symmetrically between planar clamping surface 171 and internal side wall surface 172. Curved surface 168 is tangential (as viewed in such cross section) at each end of its 90° arc; that is, tangential to planar surface 171 and to the cavity internal surface 172, respectively.

The objective in further improving the draw die of FIG. 16 is to increase the surface area of the cavity entrance zone in a manner which will provide for a more gradual multi-directional movement of can stock from a planar configuration into the configuration of the die cavity. That is, in a manner less abrupt and less likely to be damaging to the coating; and, in a manner to facilitate overcoming the inertia in the sheet metal which would resist the multi-directional changes in the metal shape which must take place as can stock moves out of its planar configuration into the cavity entrance zone and from the entrance zone into the cavity (during movement of the punch into the die cavity). Support for the can stock is improved by such configurational changes in the draw die while the relatively small area projection of the cavity entrance zone on the clamping plane is maintained. That is, better support is accomplished without decreasing the planar clamping surface available on the draw die. And, the centrally located surface of the entrance zone, which acts as the surface portion about which the can stock is drawn under tension, is formed about a smaller radius to provide a sharper configuration from which the can stock is drawn into the die.

In FIG. 17, such curved surface 168 (about single radius of curvature 166 of FIG. 16) is shown as an interrupted line; a 45° angle line 173, between the planar clamping surface and cavity side wall, is also shown by an interrupted line. Such 45° angle line 173 meets the respective points of tangency of single radius curved surface 168 with the planar clamping surface 171 at 174 and the internal side wall 172 at 175. The plane clamping surface 171 and the cavity internal surface 172 (as represented in cross section) would, if extended, define an included angle of 90".

A larger surface area 176 (FIG. 17) for the entrance zone is provided by the present invention. The multi-radii cavity entrance zone concept is carried out, in the specific embodiment being described, by selecting a radius equal to or greater than the five (5) times starting gage (or the 0.040" dimension) as the "larger" radius (RL) for the multi-radii surface. Placement of such larger radius (RL, FIG. 18) surface provides for the more gradual movement from the planar clamping surface into the cavity entrance zone and, also, for the more gradual movement of the can stock from the entrance zone into the interior side wall of the cavity.

A smaller radius (Rs) which is approximately five (5) times, or less than five (5) times, thickness gage of the can stock, with a designated maximum, is used to establish a curved surface which is intermediate such larger radius (RL) portions located at the arcuate ends of the entrance zone surface. That is, the Rs surface is centrally located of such entrance zone. The interior cavity wall 172 is recessed slightly, about 1°, in progressing from the curved surface entrance zone into the cavity.

Establishing increased-surface-area entrance zone along with the recessed taper for the draw die internal side wall are as shown in FIG. 18. A portion of the curved surface 176 is formed about center 177 using the larger radius RL (0.040" and above); such surface portion 178 is tangential to the planar clamping surface 171 of the draw die. Such larger radius is used about center 180 to provide curvilinear surface 181 leading into the internal side wall of the cavity.

To derive the loci of points for the centrally located smaller radius (Rs) of curvature portion of the curved surface, the arcs of the larger radii surfaces 178, 181 are extended to establish an imaginary point 184 at their intersection. Connecting imaginary point 184 with midpoint 185 of an imaginary line 186 between the RL centers 177, 180 provides the remaining point for establishing the loci of points (line 188) for the center of the smaller radius (Rs) of curvature; the latter will provide a curvilinear surface 190 which is tangential to both larger radius (RL) curvilinear surfaces 178 and 181.

Typically, for the can sizes and materials discussed above, the larger radius (RL) of curvature would be 0.04" and above, for example in the range of 0.040" to 0.060"; and, the smaller radius (Rs) of curvature would be less than 0.040" for example in the range of 0.020" to 0.030". For example, with a single-radius of curvature of about 0.028" an RL of 0.040" and an RS of 0.020" could be used as described in relation to FIG. 18 while the projection on the clamping plane would remain at 0.028".

In such multi-radii configurations, the smaller radius (Rs) curved surface occupies about ⅓of the curved entrance zone surface area and is located intermediate to the larger RL surfaces In the RL=0.040"Rs=0.020" embodiment, the Rs curved surface occupies slightly in excess of 37% of the total surface area of the arc between the clamping surface and internal side wall of the draw die; and, each of the RL surfaces occupies slightly less than 32% of the surface area in such a 90° arc.

However, in order to provide a 1° recessed taper for the die cavity internal surface, the arc between the planar clamping surface and such internal surface is increased by 1°; such 1° arc increase being added at the internal surface end of the arc. Such added 1° of arc enables such internal surface to be tangent to the curved surface at point 191; that is, 1° beyond the 90° point of tangency (175). A tangential recess-tapered internal side wall cannot be provided without such added arc provision as described immediately above.

The location of such 1° recessed tapered internal side wall surface, in a vertically oriented plane which includes the central longitudinal axis of the draw cavity, is shown at line 192 in relation to a non-tapered side wall surface indicated by line 172.

Considering one-piece can body configurations, profiling of the bottom wall is used with one-piece can bodies because of internal vacuum and/or pressure conditions to be encountered; and/or, for stacking or other purposes. Profiling of a side wall is used to provide internal vacuum and crush-proof protection for vacuum packed can side walls.

In accordance with the present invention, bottom wall profiling is carried out after a final-redraw can body is freed from clamping forces so as to eliminate stress or strain on side wall sheet material during such profiling. The configuration for the endwall profile can be in accordance with that shown in U.S. Pat. No. 4,120,419 of Oct. 7, 1978; carrying out desired bottom wall profiling is part of the contribution of the invention.

The profiling of unitary endwall 194 (FIGS. 19–20) is carried out through use of endwall profiling tooling in the final redraw station as described in more detail (in relation to FIGS. 21–24) later herein. A centrally located panel 195 (FIG. 19) is provided with circumscribing profile rings 196, 197. The unitary endwall panel 194 is recessed from bottom peripheral edge 198 by profiling rib 199 so that, under pressure, the central panel portion 195 can move axially toward the exterior of the can body without disturbing upright stability of the can. Under vacuum conditions, the rib profiling enables the panel portion 195 to move toward the interior of the can. Also, the bottom wall profile of FIG. 19 sacrifices less can volume than an interior dome-shaped shaped profile; for example, the normal four-inch height for a condensed soup can (211×400) can be reduced to a height of 3 15/16" through use of the bottom wall profiling of FIG. 19.

Can 200 of FIG. 20 includes chime seam 202 attaching end closure 203 to the one-piece can body 204. End closure 203 is provided with profiling of a type similar to the closed end wall; that is, with a centrally located panel 205 which can withstand internal vacuum or pressure conditions due to cooperation of profiling ribs 206, 207 and the recessed central panel.

Chime seam 202 adds to cross-sectional area at the open end of a can body. In a cylindrical embodiment chime seam 202 adds to the overall diameter of the can; and, this added diameter must be taken into consideration to provide for straight-line rolling of a cylindrical can during content processing, such as heat treatment. A "chime profile"(also referred to as a "roll bead") 208 provides a diameter substantially equal to that of the chime seam 202 for such purposes. Such roll bead can be established by adaptation of the eccentrically-mounted tooling of the type used for side wall profiling 210 located contiguous to mid-side wall height.

In carrying out a final redraw for a sanitary food can body such as shown in FIG. 19, the curved surface juncture at the bottom wall periphery of the redrawn work product is reshaped as described earlier in relation to FIGS. 8 through 12. In accordance with present teachings, bottom profiling is carried out in the final redraw station after the redraw can body forming is completed and after the can body is released from clamping action.

Figure 21:
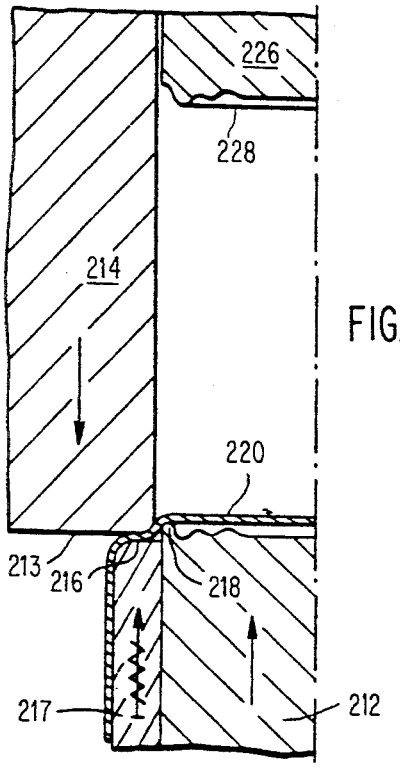
Figure 22:
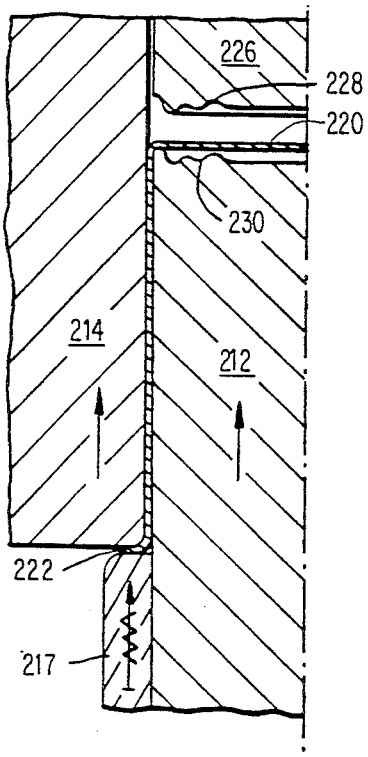

FIGS. 21 through 24 depict final redraw tooling for redrawing a cup-shaped work product and countersinking of the endwall in the same station upon completion of redraw. As shown in FIG. 21, reshaping of the curved juncture of the previous cup has been completed and the metal which is peripheral to upwardly moving redraw punch 212 is being clamped solely between the planar clamping surface 213 of draw die 214 and upper planar surface 216 of clamping tool 217 (such clamping is free of curved nesting surfaces). In a cylindrical configuration embodiment, a new diameter is being redrawn about the peripheral portion 218 of final redraw punch 212 so that endwall 220 is planar during this phase of the draw processing.

As such redraw is approaching completion (FIG. 22), the redraw punch 212 and redraw die 214 are moving in the same direction with redraw punch moving at a faster rate. Final redraw forming is controlled so that flange metal 222 remains upon release of clamping action. Male profile member 226 is fixed; so that, coaction between its profiling surface 228 and the recessed profiling surface 230 of draw punch 212 has not started.

Figure 23:
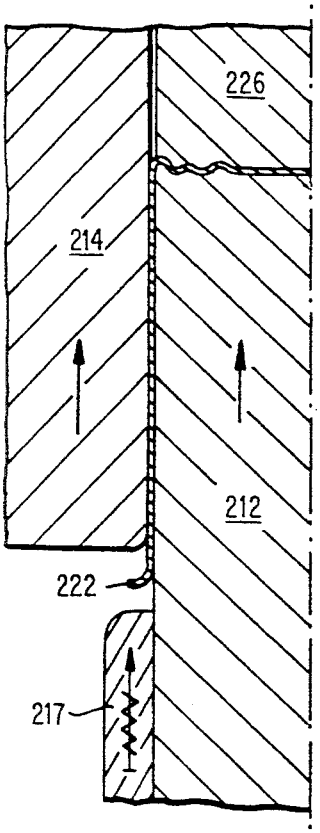

As shown in FIG. 23, clamping action has been released on flange 222 as draw die 214 moves upwardly. As clamping action is released, final redraw punch 212 approaches and reaches top dead center of its upward stroke to bring about countersinking of the endwall 230 (FIG. 22) to form the profiled endwall 194 (FIG. 19) in cooperation with fixed male profile member 228. During such countersinking, side wall metal is drawn into such endwall. The prior release of clamping action on the flange avoids damage to the sheet metal due to such movement. Final redraw punch 212 is then withdrawn downwardly upon completion of endwall profiling as draw die 214 is withdrawn upwardly.

Figure 24:
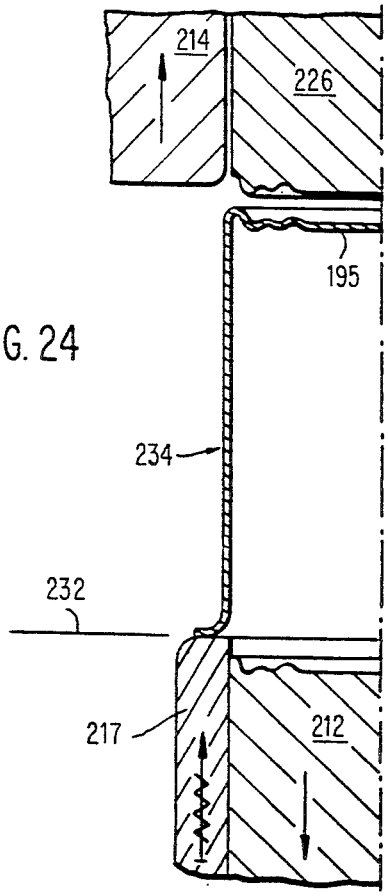

As shown in FIG. 24, upon completion of redraw forming and endwall countersinking operations, the upper planar clamping surface 216 of clamping ring 217 is positioned in the pass line 232 so that support is provided through flange metal 222 at the open end of work product 224 thus providing for movement in the pass line upon exit from the press. Redraw punch 212 is moving downwardly below the pass line and redraw die 214 is moving upwardly above the closed end of the redrawn can body 234 so that the latter is free to move from the press in the pass line.

Flat-rolled sheet metal for the can body application taught by the present invention can comprise flat-rolled steel of nominal thickness gage between about 0.005" to about 0.012"; that is, about 50 to 110#/bb in which thickness tolerances are generally within 10%; and, nominal flat-rolled aluminum thickness gages above about 0.005" to about 0.015".

The preferred substrate surface for flat-rolled steel for adhesion of organic coating is a "TFS" (tin-free steel) coating which comprises an electrolytic plating of chrome and chrome oxide. However, with the present invention, deep drawing of flat-rolled steel with other substrate surfaces for later protective organic coating, such as chrome oxide from a bath or cathodic dichromate (CDC) treatment, or as disclosed in copending U.S. application Ser. No. 07/318,677, entitled "COMPOSITE-COATED FLAT-ROLLED SHEET METAL MANUFACTURE AND PRODUCT," filed by Applicant on Mar. 3, 1989 can also be utilized to augment surface adhesion of outer surface organic coating. Organic coating and draw lubricant coating are selected for each surface to provide for draw requirements on each such surface as well as container content requirements on the product side surface. That is, the type of organic coating and blooming compound draw lubricant are selected for a particular surface of the can stock. An organic coating weight for the "public" surface in the range of about two and one-half milligrams per square inch (2.5 mg/sq. in.) to about ten mg/sq. in. is preferred; and, about five to about fifteen mg/sq. in. is preferred on the "product side." Organic coatings are preferably selected from epoxies, vinyls, organosols, acrylics, polyesters and films such as polyurethane, polypropelene, polyethylene and poly alkaline terephthalates for use with containers for comestibles. The ability to manufacture deep-drawn can bodies (in which side wall height exceeds diameter) without damage to precoated organic polymeric coatings is an important advantage of the present invention. A wide and increasing range of organic polymer coatings are finding use in canmaking. The organic coating is designated to withstand deep drawing as side wall metal is drawn, under tension, so as to avoid any significant increase in thickness gage along the side wall height. The organic coatings are selected so as to be capable of being applied with appropriate "blooming compound" draw lubricant, to meet particular surface requirements. The higher organic coating weight on the product side is utilized to assure product protection; the lubricant requirement on the product side surface is less than on the exterior.

Suitable organic coatings with blooming compound for carrying out draw processing objectives or the invention are made available based on the product and can body size requirement through such coating manufacturers as The Valspar Corporation, 2000 Westhall Street, Pittsburgh, Pa. 15233, The Dexter Corporation, East Water Street, Waukegan, Ill. 60085, or BASF Corporation of Clifton, N.J. Any surface-applied draw lubricant required is added upon curing of the organic coating; with total draw lubricant (blooming compound and surface-applied) per side being selected in the range of about ten (10) to about twenty (20) mg per square foot per side. Surface lubrication is preferably carried out, after curing of the organic coating, by coil coaters such as Precoat Finish of St. Louis, Mo. or PMP of McKeesport, Pa. to enable demand oriented operation of the can body fabricating line, independent of surface preparation, as described earlier. Such desired draw lubricant coating weights on each surface are verified before entry of can stock into the fabricating process. With present teachings, the integrity of the precoated organic coating is maintained such that neither post-fabrication interior surface coating nor coating repair is a requirement for can bodies for sanitary can packs.

Handling equipment, wall and side wall profiling machinery, flange trimming machinery, and forming press machinery for use with the one-piece can body system taught herein have been made available through Standun Canforming Systems of Rancho Dominguez, Calif.

While specific can body and can sizes, tooling dimensions, sheet metal materials and coating specifications have been set forth in describing the invention, those skilled in the art will recognize that modifications to such specific data and information can be utilized in the light of the above teachings. Therefore, for purposes of determining the scope of the present invention, reference shall be had to the appended claims.

I claim:

1. A one-piece precoated metal-substrate can body fabricated in symmetrical relationship to a central longitudinal axis by draw processing work-hardened flat-rolled sheet metal substrate precoated with an organic coating and draw lubricant; such can body as fabricated, comprising:

a closed endwall, a unitary side wall extending from such endwall in symmetrical relationship with the central longitudinal axis of the can body to define an open end for such can body, and a flange extending outwardly with respect to such central longitudinal axis at such open end in a plane which is substantially perpendicularly transverse to such central longitudinal axis;

such can body being fabricated free of any side wall ironing step during or upon completion of its fabrication such fabricated can body presenting:

an organic coating on its public side and its product side, with the organic coating on its product-side surface enabling direct use of the can body in canning comestibles free of any requirement for washing, for organic coating, or for repair of the precoated organic coating of such product-side surface, and in which the endwall metal substrate gage is substantially equal to starting thickness for such substrate, with such can body side wall being draw processed with precoated metal substrate under tension applied solely between planar clamping surfaces throughout side wall height formation, so as to be free of detriment to side wall adhesion of the precoated organic coating by eliminating any substantial increase in side wall substrate thickness gage over starting gage.

2. The one-piece can body of claim 1, in which side wall metal substrate thickness is decreased in thickness such that the average side wall decrease is about 10% to about 20% from starting thickness thereof.

3. The can body of claim 2 in which the flat-rolled sheet metal substrate comprises double-reduced flat-rolled steel having a longitudinal yield strength of about 75 to about 85 ksi (kilopounds per square inch).

4. The can body of claim 1 in which the flat-rolled sheet metal substrate comprises double-reduced flat-rolled steel, providing a cut blank of such pre-coated sheet metal substrate and draw-processing into such cup-shaped can body, in which endwall metal substrate gage substantially equals starting gage for such blank, and side wall metal substrate gage equal is to or less than starting gage of such cut blank over side wall height between such end-wall and the flange located at the open end of such side wall.

5. The can body of claim 4 in which such metal substrate disk comprises double-reduced flat-rolled steel having a thickness gage of about 0.0055" to 0.011", and, in which the product-side surface of such disk for container usage is coated with an organic coating in the range of above about five to about fifteen mg per sq. in., the public-side surface of such disk for container usage is coated with the organic coating in the range of about two and one-half to about ten mg per sq. in. and both surfaces include a draw lubricant.

* * * * *

UNITED STATES PATENT AND TRADEMARK OFFICE

CERTIFICATE OF CORRECTION

PATENT NO. : 5,409,130

DATED : April 25, 1995

INVENTOR(S) : William T. Saunders

It is certified that error appears in the above-identified patent and that said Letters Patent is hereby corrected as shown below:

At Column 1, lines 16 through 21, delete entire paragraph.

At Column 2, line 42 delete "multi-pleradii" and substitute --multiple-radii--.

At Column 12, line 35 delete "tot" before "re-" and substitute --for--.

At Column 14, line 21 delete "sheen" before "metal" and substitute --sheet--.

At Column 15, line 2 insert --(-- before "about" to read --(about the circumference)--;
line 9 change "The" before "nominal" to --the--;
line 33 change "Slightly" to --slightly--.

At Column 16, line 8 change "Facilitates" to --facilitates--;
line 10 delete "held" and substitute --help--;
line 50 insert a period at the end of the sentence --0.040").--.

UNITED STATES PATENT AND TRADEMARK OFFICE
CERTIFICATE OF CORRECTION

PATENT NO. : 5,409,130

DATED : April 25, 1995

INVENTOR(S) : William T. Saunders

It is certified that error appears in the above-identified patent and that said Letters Patent is hereby corrected as shown below:

At Column 18, line 3 insert a comma --,-- after ".040";

line 62 delete "dome-shaped shaped" and substitute --dome-shaped--.

At Column 20, line 57 delete "or" and substitute --of--.

At Column 22, line 33 delete "equal is" and substitute --is equal--.

Signed and Sealed this

Fifth Day of September, 1995

*Attest:*

*Attesting Officer*

BRUCE LEHMAN

*Commissioner of Patents and Trademarks*